US009278259B2

(12) United States Patent
Mochizuki et al.

(10) Patent No.: US 9,278,259 B2
(45) Date of Patent: Mar. 8, 2016

(54) GOLF BALL

(71) Applicant: Bridgestone Sports Co., Ltd., Minato-ku, Tokyo (JP)

(72) Inventors: Katsunobu Mochizuki, Chichibushi (JP); Hiroyuki Nagasawa, Chichibushi (JP); Takashi Akutagawa, Takaishi (JP); Naoki Shirakawa, Takaishi (JP)

(73) Assignees: Bridgestone Sports Co., Ltd., Tokyo (JP); DIC COVESTRO PPOLYMER LTD, Tokyo (JP)

( * ) Notice: Subject to any disclaimer, the term of this patent is extended or adjusted under 35 U.S.C. 154(b) by 235 days.

(21) Appl. No.: 13/795,754

(22) Filed: Mar. 12, 2013

(65) Prior Publication Data

US 2014/0274466 A1 Sep. 18, 2014

(51) Int. Cl.
*A63B 37/12* (2006.01)
*A63B 37/00* (2006.01)

(52) U.S. Cl.
CPC ..... *A63B 37/0023* (2013.01)

(58) Field of Classification Search
USPC ..... 473/324–378
See application file for complete search history.

(56) References Cited

U.S. PATENT DOCUMENTS

| | | | | |
|---|---|---|---|---|
| 5,820,491 | A * | 10/1998 | Hatch et al. | 473/378 |
| 6,624,221 | B2 | 9/2003 | Takesue et al. | |
| 6,833,400 | B2 | 12/2004 | Ichikawa et al. | |
| 2011/0070977 | A1 | 3/2011 | Nagasawa et al. | |

FOREIGN PATENT DOCUMENTS

| | | | |
|---|---|---|---|
| JP | 2001-348467 | A | 12/2001 |
| JP | 2002-336382 | A | 11/2002 |
| JP | 2011-31020 | A | 2/2011 |

* cited by examiner

*Primary Examiner* — Alvin Hunter
(74) *Attorney, Agent, or Firm* — Sughrue Mion, PLLC

(57) ABSTRACT

The invention provides a golf ball having a core encased by a cover of one or more layer, which cover is formed of a material composed primarily of a thermoplastic polyurethane material and containing also a lubricant composed primarily of a montanic acid ester. Paint film adhesion is not adversely affected even when the mold temperature during injection-molding of the golf ball is raised to 60° C. or above.

9 Claims, No Drawings

GOLF BALL

BACKGROUND OF THE INVENTION

The present invention relates to a golf ball having a core and a cover of one or more layer which has been molded over the core. More specifically, the invention relates to a golf ball having an outstanding paint film adhesion and a good durability.

Golf ball covers that use conventional thermoplastic polyurethane materials have a poor mold releasability when molded. To address this problem, use has been made of metal salts of stearic acid or polyethylene waxes as lubricant ingredients or dispersants. However, although an advantage of metal salts of stearic acid is that they increase mold releasability, perhaps because metal salts act as decomposition catalysts for thermoplastic polyurethane materials, it has been confirmed that when a metal salt of stearic acid is used as a dispersant, the metal salt lowers the heat resistance of the thermoplastic polyurethane material. As for polyethylene waxes, owing to their poor compatibility with thermoplastic polyurethane materials, when a polyethylene wax is used as a dispersant, the pigment dispersibility tends to worsen.

To provide a thermoplastic polyurethane material having an excellent mold releasability, JP-A 2002-336382 discloses a cover material which is composed primarily of a thermoplastic polyurethane material and includes also a fatty acid amide and/or montan wax.

In addition, JP-A 2001-348467 describes art which uses both a fatty acid amide and montan wax together in a resin composition for golf balls so as to give the composition a good heat resistance, flow properties and moldability, and obtain high-performance golf balls having an excellent rebound. Moreover, JP-A 2011-31020 describes the use of, as lubricants which are compounded with a base polymer for an outermost cover layer, both (A) a fatty acid amide, and (B) a composition based on a fatty acid which has 24 to 34 carbons and is selected from the group consisting of esters of montanic acid, partially saponified esters of montanic acid and metal salts of montanic acid.

In the above-cited art, the cover material contains a base resin such as a urethane resin in which both a montan wax and an amide wax are used. However, in golf balls which use such a cover material, when paint is applied to the surface of the ball, raising the temperature setting of the mold may cause the wax ingredients to bleed out to the surface and form a film, which may lead to undesirable effects such as peeling of the paint film.

SUMMARY OF THE INVENTION

It is therefore an object of the invention to provide a golf ball having a cover which is composed primarily of a thermoplastic polyurethane material, wherein paint film adhesion to the cover is not adversely affected even when, in a golf ball injection-molding operation, the temperature setting of the mold is raised to 60° C. or above.

As a result of extensive investigations, the inventors have discovered that, in a golf ball composed of a core encased by one or more cover layer and having a golf ball surface with numerous dimples thereon to which paint has been applied, by forming the cover of a cover material which is composed primarily of a thermoplastic polyurethane material and includes also a montanic acid ester as a lubricant, paint film adhesion to the cover is not adversely affected even when, in a golf ball injection-molding operation, the temperature setting of the mold is raised to 60° C. or above.

Accordingly, the invention provides the following golf ball.

[1] A golf ball comprising a core encased by a cover of one or more layer, wherein the cover is formed of a material which is composed primarily of a thermoplastic polyurethane material and includes also a lubricant composed primarily of a montanic acid ester.

[2] The golf ball of [1], wherein the thermoplastic polyurethane material and the lubricant have a compounding ratio by weight therebetween, expressed as thermoplastic polyurethane material:lubricant, of from 100:0.1 to 100:1.0.

[3] The golf ball of [1], wherein the lubricant is composed entirely of a montanic acid ester.

[4] The golf ball of [1], wherein the montanic acid ester is a partially saponified ester of montanic acid.

DETAILED DESCRIPTION OF THE INVENTION

The invention is described more fully below.

The golf ball of the invention, although not shown in an accompanying diagram, has a core of at least one layer and a cover of at least one layer encasing the core. Paint is generally applied to the surface of the cover. In addition, numerous dimples are generally formed on the cover surface. By having the cover composed of two or more layers, the golf ball can be made a multi-piece solid golf ball, such as a three-piece or four-piece ball. The core may composed of a single layer or of two or more layers.

The material used in this invention to form the cover is a resin composition which is composed primarily of a thermoplastic polyurethane material and includes also a lubricant composed primarily of a montanic acid ester. The thermoplastic polyurethane material is described in detail below.

The thermoplastic polyurethane elastomer has a structure that includes soft segments composed of a polymeric polyol (polymeric glycol) and hard segments composed of a chain extender and a diisocyanate. Here, the polymeric polyol used as a starting material is not subject to any particular limitation, and may be any that is used in the prior art relating to thermoplastic polyurethane materials, such as polyester polyols and polyether polyols. Polyether polyols are preferable to polyester polyols because they enable the synthesis of thermoplastic polyurethane materials having a high rebound resilience and excellent low-temperature properties. Illustrative examples of polyether polyols include polytetramethylene glycol and polypropylene glycol. Polytetramethylene glycol is especially preferred from the standpoint of the rebound resilience and low-temperature properties. The polymeric polyol has an average molecular weight of preferably from 1,000 to 5,000. A molecular weight of from 2,000 to 4,000 is especially preferred for synthesizing thermoplastic polyurethane materials having a high rebound resilience.

The chain extender is preferably one which is used in the prior art relating to conventional thermoplastic polyurethane materials. Illustrative, non-limiting, examples include 1,4-butylene glycol, 1,2-ethylene glycol, 1,3-butanediol, 1,6-hexanediol and 2,2-dimethyl-1,3-propanediol. These chain extenders have an average molecular weight of preferably from 20 to 15,000.

The diisocyanate is preferably one which is used in the prior art relating to conventional thermoplastic polyurethane materials. Illustrative, non-limiting, examples include aromatic diisocyanates such as 4,4'-diphenylmethane diisocyanate, 2,4-toluene diisocyanate and 2,6-toluene diisocyanate; and aliphatic diisocyanates such as hexamethylene diisocyanate. However, depending on the type of isocyanate, the crosslinking reaction during injection molding may be difficult to control. In the practice of the invention, it is most preferable to use 4,4'-diphenylmethane diisocyanate being an aromatic diisocyanate.

A commercial product may be advantageously used as the thermoplastic polyurethane material composed of the above-described materials. Illustrative examples include those available under the trade names Pandex T8180, T8195, T8290, T8295 and T8260 (available from DIC Bayer Polymer, Ltd.), and those available under the trade names Resamine 2593 and 2597 (available from Dainichi Seika Colour & Chemicals Mfg. Co., Ltd.).

In addition to the above-described components, other components may also be included in the cover-forming resin composition. Such other components are exemplified by thermoplastic polymeric materials other than thermoplastic polyurethane materials; illustrative examples include polyester elastomers, polyamide elastomers, ionomeric resins, styrene block elastomers, polyethylene, and nylon resins. The amount of thermoplastic polymeric materials other than thermoplastic polyurethane materials included in the cover-forming resin composition is not more than 50 parts by weight per 100 parts by weight of the thermoplastic polyurethane material serving as the essential ingredient, and may be suitably selected as appropriate for such purposes as adjusting the hardness, improving the resilience, improving the flow properties, and improving the adhesion of the cover material.

Next, the lubricant composed primarily of a montanic acid ester that is used in the invention is described. A lubricant is generally furnished in order to reduce friction between the synthetic resin and the processing equipment, and among particles of the synthetic resin, during resin molding. Such lubricants exist in a variety of types, including ester-based, hydrocarbon-based, fatty acid-based, fatty amide-based and metal soap-based lubricants. In this invention, an ester-based lubricant composed primarily of a montanic acid ester is used. Moreover, in the invention, montanic acid esters modified by partial saponification are also included in the above montanic acid ester. Illustrative, non-limiting, examples of the montanic acid ester include esters of ethylene glycol or glycerol with montanic acid (exemplified by the commercial products "Licowax E" and "Licolub WE4" available from Clariant (Japan) K.K.), mixed waxes composed of montanic acid esterified with butylene glycol and montanic acid saponified with calcium hydroxide (exemplified by the commercial product "Licowax OP" available from Clariant (Japan) K.K.), complex esters of montanic acid (exemplified by the commercial product "Licolub WE40" available from Clariant (Japan) K.K.), and esters of montanic acid with aliphatic polyols (exemplified by the commercial products "Licomont ET141" and "Licomont ET132" available from Clariant (Japan) K.K.). The above montanic acid esters do not readily migrate on account of their excellent compatibility, and exhibit excellent mold release effects. Moreover, because they have a low volatility at elevated temperatures, they can be advantageously used as lubricants for thermoplastic polyurethane resins.

The amount of montanic acid ester included in the lubricant is at least 50 wt %, and preferably at least 80 wt %. It is most preferable for this amount to be 100 wt %, that is, for the lubricant to be composed entirely of montanic acid ester, in which case the objects of the invention can be advantageously achieved.

The lubricant composed primarily of the above montanic acid ester is included in the thermoplastic polyurethane material in an amount which, although not particularly limited, is preferably at least 0.1 part by weight, more preferably at least 0.2 part by weight, and even more preferably at least 0.3 part by weight. The upper limit is preferably not more than 1.0 part by weight, more preferably not more than 0.8 part by weight, and even more preferably not more than 0.6 part by weight. If the amount included is smaller than the above range, sufficient improvement in colorant dispersibility and in the mold releasability of the molding may not be obtained. On the other hand, if this amount is larger than the above range, the paint film adhesion or adhesion of stamped markings to the cover may worsen.

In addition, various additives may be optionally included in the above cover-forming resin composition. For example, pigments, antioxidants, light stabilizers and ultraviolet absorbers may be suitably included.

To obtain the above cover-forming resin composition, the essential ingredients mentioned above should be mixed by a known method. No limitation is imposed on the method of preparation. Hence, the composition may be obtained by, for example, employing an internal mixer such as a kneading-type twin-screw extruder, a Banbury mixer or a kneader to compound the above essential ingredients at a heating temperature of 150 to 250° C. and using various additives according to the intended application as subsequently described.

The thickness of the cover, although not particularly limited, is preferably at least 0.3 mm, more preferably at least 0.5 mm, and even more preferably at least 0.7 mm. The upper limit is preferably not more than 2.5 mm, more preferably not more than 2.1 mm, even more preferably not more than 1.9 mm, and still more preferably not more than 1.7 mm. At a cover thickness larger than the above range, the ball rebound may decrease, worsening the flight performance. At a cover thickness smaller than the above range, the durability to cracking may worsen. In particular, if the ball is hit thin, the cover may tear.

The hardnesses of the respective layers of the cover, expressed in terms of Shore D hardness, are preferably from 30 to 70, and more preferably from 40 to 65. As used herein, "Shore D hardness of the cover layer" refers to the Shore D hardness of a resin sheet produced by injection molding, and is a value measured in accordance with ASTM D2240.

The method of molding the cover of the inventive golf ball is described. For example, the cover can be molded by feeding the above-described cover-forming resin composition to an injection molding machine, and injecting the molten cover-forming resin composition over the core. At this time, the mold temperature of the mold (temperature setting) used to mold the cover varies with the type of thermoplastic polyurethane and other ingredients, although the temperature is generally from 5 to 150° C. and is suitably set to not more than the softening temperature for the type of thermoplastic polyurethane, etc. that is used. Here, the "mold temperature of the mold (temperature setting)" refers to adjusting the mold to a fixed temperature by having a medium regulated to a temperature of from 5 to 150° C. continuously flow within the mold. As used herein, "medium" is exemplified by water, oil, and steam, but is not limited to these. The injection molding temperature differs according to the type of thermoplastic polyurethane and other ingredients, but is generally from 150 to 300° C.

The core used in the inventive golf ball is not particularly limited. For example, use may be made of the various types of cores such as solid cores for two-piece balls, solid cores having a plurality of vulcanized rubber layers, solid cores having a plurality of resin layers, and wound cores having a layer of rubber thread. No limitations are imposed on, for example, the core diameter, weight, hardness and material.

The core can be formed using a known rubber material as the base material. Known base rubbers that are either natural rubbers or synthetic rubbers may be used as the base rubber. More specifically, it is recommended that use be made of primarily polybutadiene, especially cis-1,4-polybutadiene having a cis structure content of at least 40%. If so desired, in the base rubber, other rubbers such as natural rubber, polyisoprene rubber or styrene-butadiene rubber may be suitably compounded with the above polybutadiene. The polybutadiene may be synthesized with a neodymium catalyst, which is a rare-earth catalyst, or with a metal catalyst such as a cobalt catalyst or a nickel catalyst.

Other ingredients, including co-crosslinking agents such as unsaturated carboxylic acids or metal salts thereof, inorganic fillers such as zinc oxide, barium sulfate and calcium carbonate, and organic peroxides such as dicumyl peroxide and 1,1-bis(t-butylperoxy)cyclohexane, may be compounded with the above base rubber. In addition, an antioxidant of a commercially available product may be added to the above base rubber suitably if needed.

The golf ball of the invention may have dimples molded onto the cover surface in accordance with common practice. After molding, the surface may be subjected to finishing treatment such as buffing, stamping and painting.

In cases where various paints are applied to the cover surface, owing to the need for the paint to be able to withstand the harsh conditions of golf ball use, a two-part curing urethane paint, and especially a non-yellowing urethane paint, is preferred.

The surface hardness of the cover (also referred to as "surface hardness of golf ball") is determined by the hardness of the material used in the cover or the hardness of the cover layer as a whole, and the hardness of the underlying substrate. The surface hardness of the cover, in terms of Shore D hardness, is preferably from 30 to 70. If the surface hardness of the cover is too much smaller than the above range, the ball may take on too much spin, as a result of which a satisfactory distance may not be achieved. On the other hand, if the surface hardness is larger than the above range, the ball may not take on enough spin on approach shots, which may result in inadequate controllability even for professional golfers and skilled amateurs.

The golf ball of the invention can be made to conform to the Rules of Golf for competitive play, and can be formed to a diameter which is not less than 42.67 mm and to a weight which is not more than 45.93 g. The upper limit in the diameter is preferably not more than 44.0 mm, more preferably not more than 43.5 mm, and most preferably not more than 43.0 mm. The lower limit in the weight is preferably at least 44.5 g, more preferably at least 45.0 g, even more preferably at least 45.1 g, and most preferably at least 45.2 g.

As explained above, even in cases where paint has been applied to the surface of the inventive golf ball, the paint film adhesion is excellent; i.e., the paint film does not peel when the ball is repeatedly hit. Moreover, the golf ball of the invention has a good appearance and also has a good mold releasability.

EXAMPLES

Working Examples of the invention and Comparative Examples are given below by way of illustration, and not by way of limitation.

Examples 1 to 5

Comparative Examples 1 to 5

Solid cores for two-piece solid golf balls, which cores had a diameter of 39.3 mm, were obtained by kneading the core material formulated as shown in Table 1 below, then molding and vulcanizing the core material at 160° C. for 15 minutes. This core material was the same for all the Working Examples of the invention and the Comparative Examples.

TABLE 1

| (parts by weight) | Core formulation common to Working Examples and Comparative Examples |
|---|---|
| cis-1,4-Polybutadiene | 100 |
| Zinc acrylate | 32 |
| Zinc oxide | 4 |
| Barium sulfate | 6 |
| Antioxidant | 0.2 |
| Zinc salt of pentachlorothiophenol | 1 |
| Peroxide | 1 |

Details on the ingredients shown in Table 1 are given below.

cis-1,4-Polybutadiene: Available under the trade name "BR01" from JSR Corporation Zinc acrylate: Available from Nihon Jyoryu Kogyo Co., Ltd.

Zinc oxide: Available under the trade name "Zinc Oxide Grade 3" from Sakai Chemical Co., Ltd.

Barium sulfate: Available under the trade name "Precipitated Barium Sulfate #100" from Sakai Chemical Co., Ltd.

Antioxidant: Available under the trade name "Nocrac NS-6" from Ouchi Shinko Chemical Industry Co., Ltd.

Organic Peroxide: Available under the trade name "Percumyl D" from NOF Corporation Method of Producing Cover Next, cover-forming compositions composed primarily of the thermoplastic polyurethane shown in Tables 2 and 3 were prepared. The above solid core was then placed within an injection mold and the cover-forming compositions shown in Tables 2 and 3 were injection-molded over the core, thereby giving two-piece golf balls having a cover with a thickness of 1.7 mm. Next, the molded golf balls were subjected to painting treatment by a customary process, and the resulting golf balls were left to stand at room temperature for one week, following which the ball properties were evaluated. The paint used in painting treatment was a two-part curing urethane paint (non-yellowing urethane paint).

Details on the ingredients shown in Tables 2 and 3 are given below.

Pandex T8195

A thermoplastic polyurethane material available under this trade name from DIC Bayer Polymer, Ltd.; resin hardness (Shore A), 95.

Titanium Oxide

Available under the trade name "Tipaque R550" from Ishihara Sangyo Kaisha, Ltd.

Montan Wax

A partially saponified ester of montanic acid.

Amide Wax

Ethylene bis(stearamide)

Cover Molding Conditions

The cover-forming compositions shown in Tables 2 and 3 were used as the cover materials for two-piece golf balls in the respective examples. First, the solid core described above was placed in an injection mold. Next, using an injection molding machine (temperature settings: hopper, 160° C.; cylinder, 180 to 220° C.), the molten cover-forming resin composition was injected over the core and held for a cooling time (20 to 45 seconds) within the mold which had been adjusted to the mold temperature setting (60 to 75° C.), thereby producing a two-piece golf ball (diameter, 42.7 mm; weight, 45.5 g).

TABLE 2

| | | Example | | | | |
|---|---|---|---|---|---|---|
| | | 1 | 2 | 3 | 4 | 5 |
| Formulation | Pandex T8195 (pbw) | 100 | 100 | 100 | 100 | 100 |
| | Titanium oxide (pbw) | 3.5 | 3.5 | 3.5 | 3.5 | 3.5 |
| | Ultramarine blue (pbw) | 0.1 | 0.1 | 0.1 | 0.1 | 0.1 |
| | Montan wax (pbw) | 0.3 | 0.3 | 0.6 | 0.3 | 0.3 |
| | Amide wax (pbw) | 0 | 0 | 0 | 0 | 0 |
| Properties | Surface hardness (Shore D hardness) | 53 | 53 | 53 | 53 | 53 |
| | Cover thickness (mm) | 1.7 | 1.7 | 1.7 | 1.7 | 1.7 |
| | Diameter (mm) | 42.70 | 42.70 | 42.71 | 42.69 | 42.67 |
| Conditions | Mold temperature setting (° C.) | 60 | 60 | 60 | 65 | 75 |
| | Cooling time (sec) | 20 | 45 | 45 | 20 | 20 |
| | Molding temperature (° C.) | 220 | 220 | 220 | 220 | 220 |
| Evaluations | Paint film adhesion (number of shots taken before peeling occurred) | 100 (no peeling) | 100 (no peeling) | 100 (no peeling) | 100 (no peeling) | 100 (no peeling) |
| | Appearance | good | good | good | good | good |
| | Mold releasability (condition) | good | good | good | good | good |

TABLE 3

| | | Comparative Example | | | | |
|---|---|---|---|---|---|---|
| | | 1 | 2 | 3 | 4 | 5 |
| Formulation | Pandex T8195 (pbw) | 100 | 100 | 100 | 100 | 100 |
| | Titanium oxide (pbw) | 3.5 | 3.5 | 3.5 | 3.5 | 3.5 |
| | Ultramarine blue (pbw) | 0.1 | 0.1 | 0.1 | 0.1 | 0.1 |
| | Montan wax (pbw) | 0.3 | 0.1 | 0.3 | 0.1 | 0.3 |
| | Amide wax (pbw) | 0.4 | 0.1 | 0.4 | 0.1 | 0.4 |
| Properties | Surface hardness (Shore D hardness) | 53 | 53 | 53 | 53 | 53 |
| | Cover thickness (mm) | 1.7 | 1.7 | 1.7 | 1.7 | 1.7 |
| | Diameter (mm) | 42.67 | 42.68 | 42.64 | 42.66 | 42.67 |
| Conditions | Mold temperature setting (° C.) | 60 | 65 | 65 | 75 | 75 |
| | Cooling time (sec) | 20 | 20 | 20 | 20 | 20 |
| | Molding temperature (° C.) | 220 | 220 | 220 | 220 | 220 |
| Evaluations | Paint film adhesion (number of shots taken before peeling occurred) | 20 | 50 | 20 | 50 | 20 |
| | Appearance | good | good | good | good | good |
| | Mold releasability (condition) | good | good | good | good | good |

The properties of the cover and the golf ball were determined based on the criteria described below. Those results are shown in Table 3.

Cover Surface Hardness (Ball Surface Hardness)

Five finished balls were held isothermally at 23° C., following which the cover surface hardnesses of the balls were measured at two randomly selected points at dimple-free land areas on each ball surface. Measurement was carried out with a type D durometer in accordance with ASTM-2240.

Paint Film Adhesion

Adhesion by the paint film was evaluated by carrying out the durability test described below. Each ball was shot 100 times (because one shot includes a rebound, this corresponds to two impacts), and the number of shots taken before peeling occurred was recorded. The rating criteria were as follows.

Pass: No peeling of paint film after 100 shots

Fail: Peeling of paint film arose after less than 100 shots

Durability Test

The durability of the golf ball was evaluated using an ADC Ball COR Durability Tester produced by Automated Design Corporation (U.S.). This tester fires a golf ball pneumatically and causes it to repeatedly strike two metal plates arranged in parallel. The incident velocity against the metal plates was set at 43 m/s. The number of shots required for the golf ball to crack was measured.

Appearance

The ball appearance was visually rated according to the following criteria.

Good: No visible appearance defects such as silver streaking and weld lines

NG: Appearance defects such as silver streaking and weld lines are visible

Mold Releasability

The mold releasability of the ball was rated according to the following criteria.

Good: Easily removable from the mold during demolding

NG: Not easily removable from mold during demolding

As shown in the above tables, compared with the golf balls of Comparative Examples 1 to 5, the golf balls of Examples 1 to 5 according to the invention did not undergo peeling of the paint film when repeatedly struck and thus had an outstanding paint film adhesion. Moreover, the golf balls of Examples 1 to 5 had a good appearance and also a good mold releasability.

The invention claimed is:

1. A golf ball comprising a core encased by a cover of one or more layer, wherein the cover is formed of a material which is composed primarily of a thermoplastic polyurethane material and includes also a lubricant composed entirely of a montanic acid ester, wherein the thermoplastic polyurethane material and the lubricant have a compounding ratio by weight therebetween, expressed as thermoplastic polyurethane material: lubricant, of from 100:0.3 to 100:0.6.

2. The golf ball of claim 1, wherein the montanic acid ester is a partially saponified ester of montanic acid.

3. The golf ball of claim 1, which is a two-piece golf ball having a cover.

4. The golf ball of claim 1, wherein the thickness of the cover is not more than 1.9 mm.

5. The golf ball of claim 1, wherein the thickness of the cover is not more than 1.7 mm.

6. The golf ball of claim 1, wherein the cover has a Shore D hardness of from 40 to 65.

7. The golf ball of claim 1, wherein the surface hardness of the ball is from 30 to 70 in Shore D hardness.

8. The golf ball of claim 1, wherein a two-part curing urethane paint is applied to the cover surface.

9. The golf ball of claim 8, wherein the two-part curing urethane paint is a non-yellowing urethane paint.

* * * * *